US010119358B2

(12) United States Patent
Walton et al.

(10) Patent No.: US 10,119,358 B2
(45) Date of Patent: Nov. 6, 2018

(54) DEGRADABLE WELLBORE ISOLATION DEVICES WITH VARYING DEGRADATION RATES

(71) Applicant: Halliburton Energy Services, Inc., Houston, TX (US)

(72) Inventors: Zachary William Walton, Carrollton, TX (US); Michael Linley Fripp, Carrollton, TX (US); Zachary Ryan Murphree, Dallas, TX (US); John Todd Broome, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 330 days.

(21) Appl. No.: 14/651,750

(22) PCT Filed: Aug. 14, 2014

(86) PCT No.: PCT/US2014/050993
§ 371 (c)(1),
(2) Date: Jun. 12, 2015

(87) PCT Pub. No.: WO2016/024974
PCT Pub. Date: Feb. 18, 2016

(65) Prior Publication Data
US 2016/0273300 A1 Sep. 22, 2016

(51) Int. Cl.
*E21B 33/12* (2006.01)
*E21B 33/128* (2006.01)
(Continued)

(52) U.S. Cl.
CPC ..... *E21B 33/1285* (2013.01); *E21B 33/12* (2013.01); *E21B 33/1204* (2013.01);
(Continued)

(58) Field of Classification Search
CPC .... E21B 43/26; E21B 33/1285; E21B 33/134; E21B 33/1204; E21B 33/1208; E21B 33/16; E21B 33/1293; E21B 33/12
(Continued)

(56) References Cited

U.S. PATENT DOCUMENTS 7,168,494 B2 1/2007 Starr et al.
8,307,892 B2 11/2012 Frazier
(Continued)

FOREIGN PATENT DOCUMENTS

WO WO-2013169418 A1 11/2013
WO WO-2014014591 A1 1/2014
(Continued)

OTHER PUBLICATIONS

International Search Report and Written Opinion for PCT/US2014/050993 dated May 13, 2015.
(Continued)

*Primary Examiner* — George S Gray
(74) *Attorney, Agent, or Firm* — McGuireWoods LLP

(57) ABSTRACT

An example downhole tool includes a wellbore isolation device that provides a plurality of components including one or more first components and one or more second components. Each component is made of a degradable material that degrades when exposed to a wellbore environment, and the one or more first components degrades at a first degradation rate while the one or more second components degrades at a second degradation rate that is slower than the first degradation rate.

25 Claims, 2 Drawing Sheets

(51) Int. Cl.

| | |
|---|---|
| ***E21B 33/129*** | (2006.01) |
| ***E21B 33/134*** | (2006.01) |
| ***E21B 33/16*** | (2006.01) |
| ***E21B 43/26*** | (2006.01) |

(52) U.S. Cl.
CPC ..... *E21B 33/1208* (2013.01); *E21B 33/1293* (2013.01); *E21B 33/134* (2013.01); *E21B 33/16* (2013.01); *E21B 43/26* (2013.01)

(58) Field of Classification Search
USPC ..... 166/376
See application file for complete search history.

(56) References Cited

U.S. PATENT DOCUMENTS

| | | | | |
|---|---|---|---|---|
| 8,746,342 | B1 | 6/2014 | Nish et al. | |
| 8,877,831 | B2 | 11/2014 | Roddy et al. | |
| 2005/0205266 | A1* | 9/2005 | Todd | E21B 33/12 166/376 |
| 2006/0113077 | A1 | 6/2006 | Willberg et al. | |
| 2010/0270031 | A1 | 10/2010 | Patel | |
| 2011/0048743 | A1 | 3/2011 | Stafford et al. | |
| 2011/0067889 | A1 | 3/2011 | Marya et al. | |
| 2011/0186306 | A1 | 8/2011 | Marya et al. | |
| 2012/0006561 | A1* | 1/2012 | Johnson | E21B 23/04 166/373 |
| 2012/0273229 | A1 | 11/2012 | Xu et al. | |
| 2012/0276356 | A1 | 11/2012 | Xu et al. | |
| 2012/0318513 | A1 | 12/2012 | Mazyar et al. | |
| 2013/0043041 | A1 | 2/2013 | McCoy et al. | |
| 2013/0048305 | A1 | 2/2013 | Xu et al. | |
| 2013/0112429 | A1 | 5/2013 | Crews | |
| 2013/0300066 | A1 | 11/2013 | Xu et al. | |
| 2013/0327540 | A1 | 12/2013 | Hamid et al. | |
| 2014/0014339 | A1* | 1/2014 | O'Malley | E21B 43/261 166/281 |
| 2014/0110112 | A1 | 4/2014 | Jordan, Jr. | |
| 2014/0158378 | A1 | 6/2014 | Xu et al. | |
| 2014/0190685 | A1* | 7/2014 | Frazier | E21B 33/1208 166/250.01 |
| 2014/0190705 | A1 | 7/2014 | Fripp et al. | |
| 2014/0202708 | A1* | 7/2014 | Jacob | E21B 23/01 166/376 |
| 2015/0129239 | A1* | 5/2015 | Richard | E21B 23/06 166/377 |
| 2015/0247376 | A1 | 9/2015 | Tolman et al. | |
| 2015/0337618 | A1 | 11/2015 | Hern et al. | |
| 2016/0201425 | A1 | 7/2016 | Walton et al. | |
| 2017/0158942 | A1* | 6/2017 | Okura | C09K 8/426 |

FOREIGN PATENT DOCUMENTS

| | | | |
|---|---|---|---|
| WO | 2016024974 | A1 | 2/2016 |
| WO | WO-2016025682 | A1 | 2/2016 |

OTHER PUBLICATIONS

Canadian Office Action from Canadian Patent Application No. 2,952,007, dated Nov. 8, 2017, 3 pages.
Canadian Office Action from Canadian Patent Application No. 2,952,650, dated Oct. 17, 2017, 4 pages.

* cited by examiner

DEGRADABLE WELLBORE ISOLATION DEVICES WITH VARYING DEGRADATION RATES

BACKGROUND

The present disclosure generally relates to downhole tools used in the oil and gas industry and, more particularly, to degradable wellbore isolation devices.

In the drilling, completion, and stimulation of hydrocarbon-producing wells, a variety of downhole tools are used. For example, it is often desirable to seal portions of a wellbore, such as during fracturing operations when various fluids and slurries are pumped from the surface into the casing string and forced out into a surrounding subterranean formation. It thus becomes necessary to seal the wellbore and thereby provide zonal isolation. Wellbore isolation devices, such as packers, bridge plugs, and fracturing plugs (i.e., "frac" plugs) are designed for these general purposes and are well known in the art of producing hydrocarbons, such as oil and gas. Such wellbore isolation devices may be used in direct contact with the formation face of the wellbore, with a casing string extended and secured within the wellbore, or with a screen or wire mesh.

After the desired downhole operation is complete, the seal formed by the wellbore isolation device must be broken and the tool itself removed from the wellbore. Removing the wellbore isolation device may allow hydrocarbon production operations to commence without being hindered by the presence of the downhole tool. Removing wellbore isolation devices, however, is traditionally accomplished by a complex retrieval operation that involves milling or drilling out a portion of the wellbore isolation device, and subsequently mechanically retrieving its remaining portions. To accomplish this, a tool string having a mill or drill bit attached to its distal end is introduced into the wellbore and conveyed to the wellbore isolation device to mill or drill out the wellbore isolation device. After drilling out the wellbore isolation device, the remaining portions of the wellbore isolation device may be grasped onto and retrieved back to the surface with the tool string for disposal. As can be appreciated, this retrieval operation can be a costly and time-consuming process.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure generally relates to downhole tools used in the oil and gas industry and, more particularly, to degradable wellbore isolation devices.

The present disclosure describes embodiments of wellbore isolation devices that include multiple structural components that are made of degradable materials. The components may be made of degradable materials that exhibit predetermined or unique degradation rates such that the components may degrade at varying degradation rates to avoid premature detachment of the wellbore isolation device from within a wellbore. In at least one embodiment, one or more of the components that anchor the wellbore isolation device in the wellbore may exhibit a degradation rate that is greater than the degradation rate of other structural components of the wellbore isolation device.

As used herein, the term "degradable" and all of its grammatical variants (e.g., "degrade," "degradation," "degrading," and the like) refers to the dissolution or chemical conversion of materials into smaller components, intermediates, or end products by at least one of solubilization, hydrolytic degradation, biologically formed entities (e.g., bacteria or enzymes), chemical reactions (including electrochemical reactions), thermal reactions, or reactions induced by radiation. In some instances, the degradation of the material may be sufficient for the mechanical properties of the material to be reduced to a point that the material no longer maintains its integrity and, in essence, falls apart or sloughs off. The conditions for degradation are generally wellbore conditions where an external stimulus may be used to initiate or effect the rate of degradation. For example, the pH of the fluid that interacts with the material may be changed by introduction of an acid or a base. The term "wellbore environment" includes both naturally occurring wellbore environments and introduced materials or fluids into the wellbore. As discussed in detail below, degradation of the degradable materials identified herein may be accelerated, rapid, or normal, degrading anywhere from about 30 minutes to about 40 days from first contact with the appropriate wellbore environment or stimulant.

Figure 1:
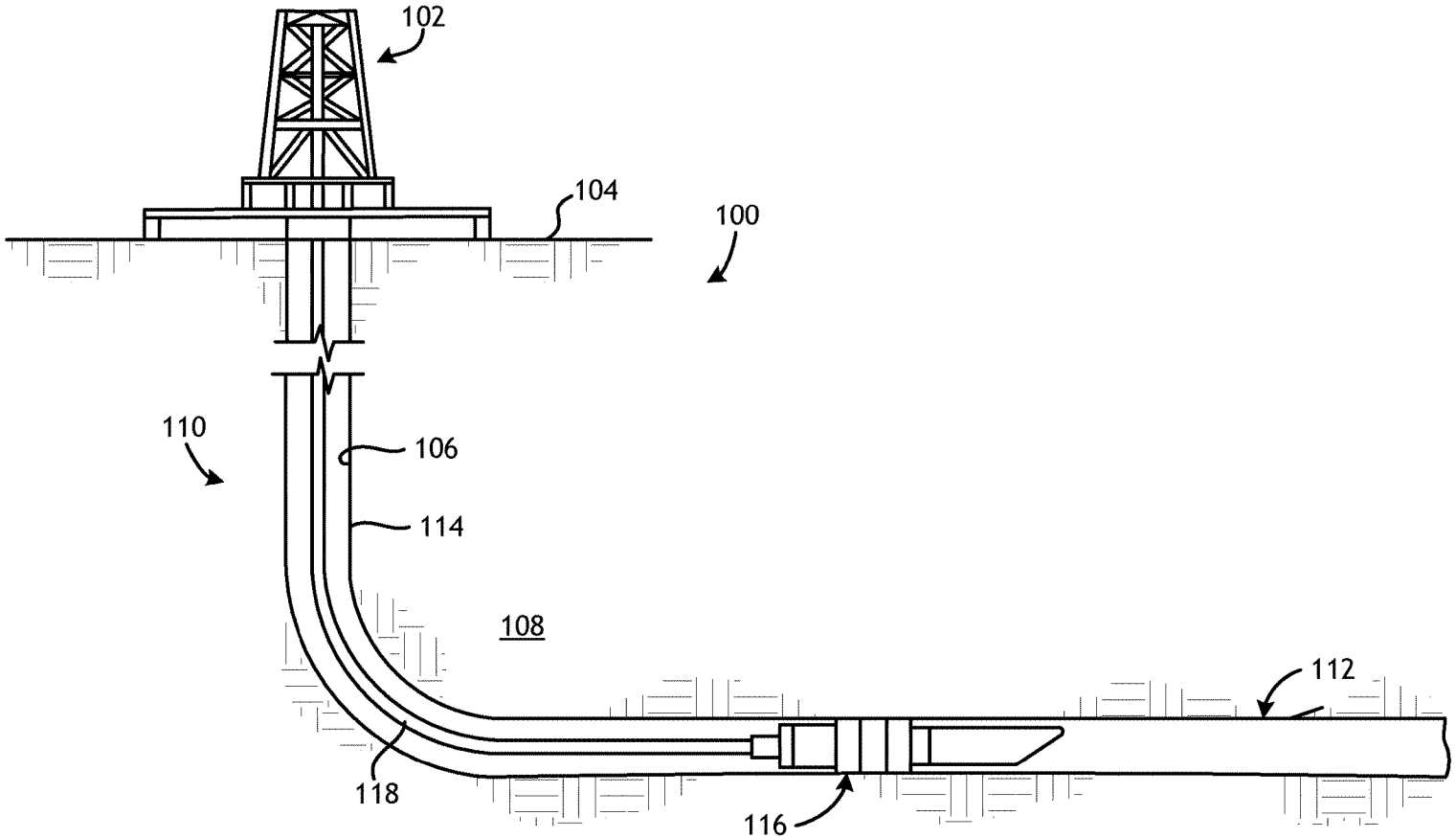
FIG. 1 is a well system that can employ one or more principles of the present disclosure, according to one or more embodiments.

Referring to FIG. 1, illustrated is a well that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a wellbore isolation device 116 that may be conveyed into the wellbore 106 on a conveyance 118 that extends from the service rig 102. The wellbore isolation device 116 may include or otherwise comprise any type of casing or borehole isolation device known to those skilled in the art including, but not limited to, a frac plug, a ball, a frac ball, a sliding sleeve, a bridge plug, a wellbore packer, a wiper plug, a cement plug, or any combination thereof. The conveyance 118 that delivers the wellbore isolation device 116 downhole may be, but is not limited to, wireline, slickline, an electric line, coiled tubing, drill pipe, production tubing, or the like.

The wellbore isolation device 116 may be conveyed downhole to a target location (not shown) within the wellbore 106. At the target location, the wellbore isolation device may be actuated or "set" to seal the wellbore 106 and otherwise provide a point of fluid isolation within the wellbore 106. In some embodiments, the wellbore isolation device 116 is pumped to the target location using hydraulic pressure applied from the service rig 102 at the surface 104. In such embodiments, the conveyance 118 serves to maintain control of the wellbore isolation device 116 as it traverses the wellbore 106 and provides the necessary power to actuate and set the wellbore isolation device 116 upon reaching the target location. In other embodiments, the wellbore isolation device 116 freely falls to the target location under the force of gravity to traverse all or part of the wellbore 106.

It will be appreciated by those skilled in the art that even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
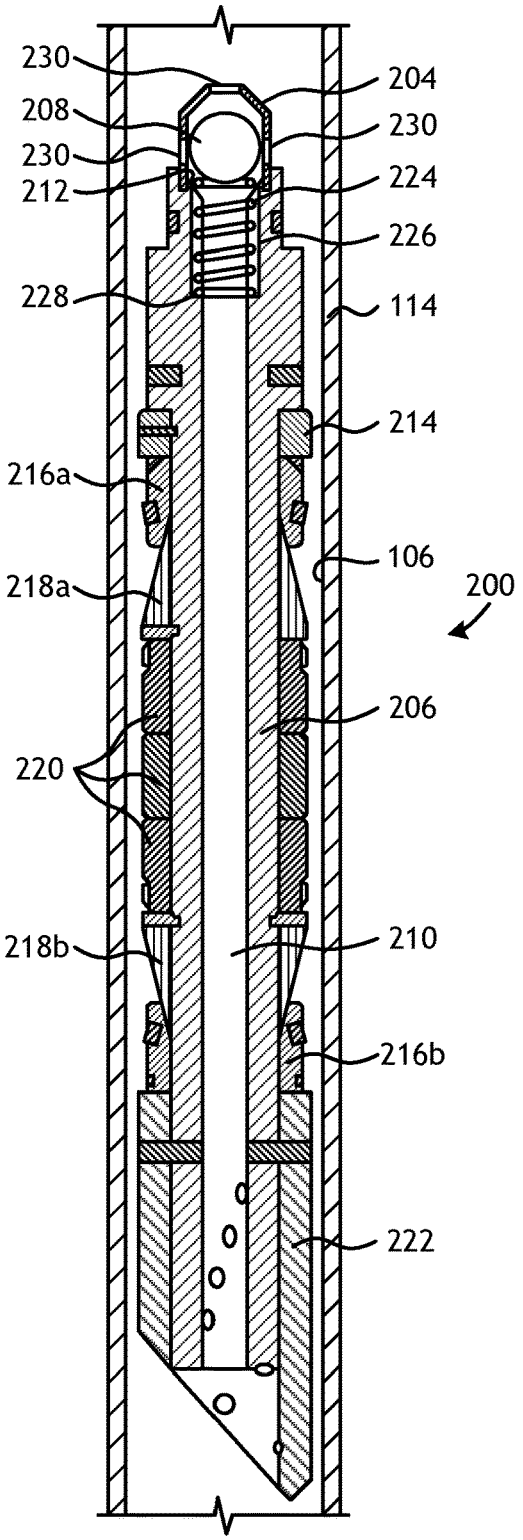
FIG. 2 illustrates a cross-sectional view of an exemplary wellbore isolation device that can employ one or more principles of the present disclosure, according to one or more embodiments.

Referring now to FIG. 2, with continued reference to FIG. 1, illustrated is a cross-sectional view of an exemplary wellbore isolation device 200 that may employ one or more of the principles of the present disclosure, according to one or more embodiments. The wellbore isolation device 200 may be similar to or the same as the wellbore isolation device 116 of FIG. 1. Accordingly, the wellbore isolation device 200 may be configured to be extended into and seal the wellbore 106 at a target location, and thereby prevent fluid flow past the wellbore isolation device 200 for wellbore completion or stimulation operations. In some embodiments, as illustrated, the wellbore 106 may be lined with the casing 114 or another type of wellbore liner or tubing in which the wellbore isolation device 200 may suitably be set. In other embodiments, however, the casing 114 may be omitted and the wellbore isolation device 200 may instead be set in an "open-hole" environment.

The wellbore isolation device 200 is generally depicted and described herein as a hydraulic frac plug. It will be appreciated by those skilled in the art, however, that the principles of this disclosure may equally be applied to any of the other aforementioned types of casing or borehole isolation devices, without departing from the scope of the disclosure. Indeed, the wellbore isolation device 200 may be any of a frac plug, a frac ball, a bridge plug, a wellbore packer, a wiper plug, a cement plug, or any combination thereof in keeping with the principles of the present disclosure.

As illustrated, the wellbore isolation device 200 may include a ball cage 204 extending from or otherwise coupled to the upper end of a mandrel 206. A sealing or "frac" ball 208 is disposed in the ball cage 204 and the mandrel 206 defines a longitudinal central flow passage 210. The mandrel 206 also defines a ball seat 212 at its upper end. One or more spacer rings 214 (one shown) may be secured to the mandrel 206 and otherwise extend thereabout. The spacer ring 214 provides an abutment, which axially retains a set of upper slips **216*a* that are also positioned circumferentially about the mandrel 206. As illustrated, a set of lower slips 216*b* may be arranged distally from the upper slips 216*a***.

One or more slip wedges 218 (shown as upper and lower slip wedges **218*a* and 218*b*, respectively) may also be positioned circumferentially about the mandrel 206, and a packer assembly consisting of one or more expandable or inflatable packer elements 220 may be disposed between the upper and lower slip wedges 218*a,b* and otherwise arranged about the mandrel 206. It will be appreciated that the particular packer assembly depicted in FIG. 2 is merely representative as there are several packer arrangements known and used within the art. For instance, while three packer elements 220 are shown in FIG. 2, the principles of the present disclosure are equally applicable to wellbore isolation devices that employ more or less than three packer elements 220**, without departing from the scope of the disclosure.

A mule shoe 222 may be positioned at or otherwise secured to the mandrel 206 at its lower or distal end. As will be appreciated, the lower most portion of the wellbore isolation device 200 need not be a mule shoe 222, but could be any type of section that serves to terminate the structure of the wellbore isolation device 200, or otherwise serves as a connector for connecting the wellbore isolation device 200 to other tools, such as a valve, tubing, or other downhole equipment.

In some embodiments, a spring 224 may be arranged within a chamber 226 defined in the mandrel 206 and otherwise positioned coaxial with and fluidly coupled to the central flow passage 210. At one end, the spring 224 biases a shoulder 228 defined by the chamber 226 and at its opposing end the spring 224 engages and otherwise supports the frac ball 208. The ball cage 204 may define a plurality of ports 230 (three shown) that allow the flow of fluids therethrough, thereby allowing fluids to flow through the length of the wellbore isolation device 200 via the central flow passage 210.

As the wellbore isolation device 200 is lowered into the wellbore 106, the spring 224 prevents the frac ball 208 from engaging the ball seat 212. As a result, fluids may pass through the wellbore isolation device 200; i.e., through the ports 230 and central flow passage 210. The ball cage 204 retains the frac ball 208 such that it is not lost during translation into the wellbore 106 to its target location. Once the wellbore isolation device 200 reaches the target location, a setting tool (not shown) of a type known in the art can be utilized to move the wellbore isolation device 200 from its unset position (shown in FIG. 2) to a set position. The setting tool may operate via various mechanisms to anchor the wellbore isolation device 200 in the wellbore 106 including, but not limited to, hydraulic setting, mechanical setting, setting by swelling, setting by inflation, and the like. In the set position, the slips **216*a,b* and the packer elements 220 expand and engage the inner walls of the casing 114**.

When it is desired to seal the wellbore 106 at the target location with the wellbore isolation device 200, fluid is injected into the wellbore 106 and conveyed to the wellbore isolation device 200 at a predetermined flow rate that overcomes the spring force of the spring 224. As the fluid flow overcomes the spring force of the spring 224, the frac ball 208 is forced downwardly until it sealingly engages the ball seat 212. When the frac ball 208 is engaged with the ball seat 212 and the packer elements 220 are in their set position, fluid flow past or through the wellbore isolation device 200 in the downhole direction is effectively prevented. At that point, completion or stimulation operations may be undertaken by injecting a treatment or completion fluid into the wellbore 106 and forcing the treatment/completion fluid out of the wellbore 106 and into a subterranean formation above the wellbore isolation device 200.

Following completion and/or stimulation operations, the wellbore isolation device 200 must be removed from the wellbore 106 in order to allow production operations to effectively occur without being hindered by the emplacement of the wellbore isolation device 200. According to the present disclosure, several components of the wellbore isolation device 200 may be made of or otherwise comprise a degradable material configured to degrade or dissolve and thereby remove the wellbore isolation device 200 from the wellbore 106 at the target location. Exemplary components of the wellbore isolation device 200 that may be made of or otherwise comprise a degradable material include, but are not limited to, the mandrel 206, the frac ball 208, the upper and lower slips 216*a,b*, the upper and lower slip wedges 218*a,b*, the packer elements 220, and the mule shoe 222. In addition to the foregoing, other components of the wellbore isolation device 200 that may be made of or otherwise comprise a degradable material include extrusion limiters and shear pins associated with the wellbore isolation device 200. The foregoing structural elements or components of the wellbore isolation device 200 are collectively referred to herein as "the components" in the following discussion.

Each of the components of the wellbore isolation device 200 may be made of a degradable material that exhibits a predetermined or unique degradation rate. As will be appreciated, if all the components of the wellbore isolation device 200 exhibited the same degradation rate, the upper and lower slips 216*a,b* may degrade to a point that disengages the wellbore isolation device 200 before the mandrel 206 and the mule shoe 222 fully degrade. In such a scenario, non-degraded portions of the wellbore isolation device 200 could flow uphole, including large portions of the mandrel 206 and the mule shoe 222, and potentially disrupt subsequent wellbore operations. Accordingly, the components of the wellbore isolation device 200 may be configured to degrade at varying degradation rates to avoid premature detachment of the wellbore isolation device 200.

In some embodiments, two or more of the components may exhibit the same or substantially the same degradation rate and, therefore, may be configured to degrade at about the same rate. In other embodiments, one or more of the components may be configured to degrade or dissolve at a degradation rate that is different from the other components. In at least one embodiment, one or more of the components that anchor the wellbore isolation device 200 in the wellbore 106 may exhibit a degradation rate that is lower (i.e., slower) than the degradation rate of other components to avoid having portions of the wellbore isolation device 200 prematurely detach from the wellbore 106 and flow uphole. Consequently, in at least one embodiment, the upper and lower slips 216*a,b*, the upper and lower slip wedges 218*a,b*, and/or the packer elements 220, which cooperatively anchor the wellbore isolation device 200 in the wellbore 106, may exhibit a degradation rate that is lower (i.e., slower) than the mandrel 206, the mule shoe 222, or the frac ball 208. In such embodiments, the mandrel 206, the mule shoe 222, and the frac ball 208 will degrade or otherwise dissolve prior to the degradation of the upper and lower slips 216*a,b*, the upper and lower slip wedges 218*a,b*, and the packer elements 220.

The degradation rate of a given degradable material may be accelerated, rapid, or normal, as defined herein. Accelerated degradation may be in the range of from a lower limit of about 30 minutes, 1 hour, 2 hours, 3 hours, 4 hours, 5 hours, and 6 hours to an upper limit of about 12 hours, 11 hours, 10 hours, 9 hours, 8 hours, 7 hours, and 6 hours, encompassing any value or subset therebetween. Rapid degradation may be in the range of from a lower limit of about 12 hours, 1 day, 2 days, 3 days, 4 days, and 5 days to an upper limit of about 10 days, 9 days, 8 days, 7 days, 6 days, and 5 days, encompassing any value or subset therebetween. Normal degradation may be in the range of from a lower limit of about 12 days, 13 days, 14 days, 15 days, 16 days, 17 days, 18 days, 19 days, 20 days, 21 days, 22 days, 23 days, 24 days, 25 days, and 26 days to an upper limit of about 40 days, 39 days, 38 days, 37 days, 36 days, 35 days, 34 days, 33 days, 32 days, 31 days, 30 days, 29 days, 28 days, 27 days, and 26 days, encompassing any value or subset therebetween. Accordingly, degradation of the degradable material may be between about 30 minutes to about 40 days, depending on a number of factors including, but not limited to, the type of degradable material selected, the conditions of the wellbore environment, and the like.

Suitable degradable materials that may be used in accordance with the embodiments of the present disclosure include borate glass, polyglycolic acid (PGA), polylactic acid (PLA), a degradable rubber, degradable polymers, galvanically-corrodible metals, dissolvable metals, dehydrated salts, and any combination thereof. The degradable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the degradable material of aqueous fluids or hydrocarbon fluids present within the wellbore environment such that the mechanical properties of the degradable material degrade or fail. Exemplary hydrocarbon fluids that may swell and degrade the degradable material include, but are not limited to, crude oil, a fractional distillate of crude oil, a saturated hydrocarbon, an unsaturated hydrocarbon, a branched hydrocarbon, a cyclic hydrocarbon, and any combination thereof. Exemplary aqueous fluids that may swell to degrade the degradable material include, but are not limited to, fresh water, saltwater (e.g., water containing one or more salts dissolved therein), brine (e.g., saturated salt water), seawater, acid, bases, or combinations thereof. In degradation by swelling, the degradable material continues to absorb the aqueous and/or hydrocarbon fluid until its mechanical properties are no longer capable of maintaining the integrity of the degradable material and it at least partially falls apart. In some embodiments, the degradable material may be designed to only partially degrade by swelling in order to ensure that the mechanical properties of the component formed from the degradable material is sufficiently capable of lasting for the duration of the specific operation in which it is utilized.

Degradation by dissolving involves a degradable material that is soluble or otherwise susceptible to an aqueous fluid or a hydrocarbon fluid, such that the aqueous or hydrocarbon fluid is not necessarily incorporated into the degradable material (as is the case with degradation by swelling), but becomes soluble upon contact with the aqueous or hydrocarbon fluid.

Degradation by undergoing a chemical change may involve breaking the bonds of the backbone of the degradable material (e.g., a polymer backbone) or causing the bonds of the degradable material to crosslink, such that the degradable material becomes brittle and breaks into small pieces upon contact with even small forces expected in the wellbore environment.

Thermal degradation of the degradable material involves a chemical decomposition due to heat, such as the heat present in a wellbore environment. Thermal degradation of some degradable materials mentioned or contemplated herein may occur at wellbore environment temperatures that exceed about 93° C. (or about 200° F.).

With respect to degradable polymers used as a degradable material, a polymer is considered to be "degradable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(ε-caprolactones), poly(hydroxybutyrates), poly(anhydrides), aliphatic or aromatic polycarbonates, poly(orthoesters), poly(amino acids), poly(ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof. Of these degradable polymers, as mentioned above, polyglycolic acid and polylactic acid may be preferred. Polyglycolic acid and polylactic acid tend to degrade by hydrolysis as the temperature increases.

Polyanhydrides are another type of particularly suitable degradable polymer useful in the embodiments of the present disclosure. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the degradable material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly(m-methylstyrene), poly(p-methylstyrene), poly(2,4-dimethylstyrene), poly(2,5-dimethylstyrene), poly(p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the degradable material forming the component may be any amount that confers a desirable elasticity without affecting the desired amount of degradation. In some embodiments, the thermoplastic polymer may be included in an amount in the range of a lower limit of about 1%, 5%, 10%, 15%, 20%, 25%, 30%, 35%, 40%, and 45% to an upper limit of about 91%, 85%, 80%, 75%, 70%, 65%, 60%, 55%, 50%, and 45% by weight of the degradable material, encompassing any value or subset therebetween.

With respect to galvanically-corrodible metals used as a degradable material, the galvanically-corrodible metal may be configured to degrade via an electrochemical process in which the galvanically-corrodible metal corrodes in the presence of an electrolyte (e.g., brine or other salt-containing fluids present within the wellbore 106). Suitable galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Suitable galvanically-corrodible metals also include a nano-structured matrix galvanic materials. One example of a nano-structured matrix micro-galvanic material is a magnesium alloy with iron-coated inclusions. Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation. Micro-galvanically corrodible magnesium alloys could also be solution structured with other elements such as zinc, aluminum, nickel, iron, carbon, tin, silver, copper, titanium, rare earth elements, et cetera. Micro-galvanically corrodible aluminum alloys could be in solution with elements such as nickel, iron, carbon, tin, silver, copper, titanium, gallium, et cetera.

In some embodiments, the degradable material may release an accelerant during degradation that accelerates the degradation of the component itself or an adjacent component of the wellbore isolation device 200. In at least one embodiment, for instance, one or more of the components may be configured to release the accelerant to initiate and accelerate degradation of its own degradable material. In other cases, the accelerant may be embedded in the degradable material of one or more of the components and gradually released as the corresponding component degrades. In some embodiments, for example, the accelerant is a natural component released upon degradation of the degradable material, such as an acid (e.g., release of an acid upon degradation of the degradable material formed from a polylactide). Similarly, degradation of the degradable material may release a base that would aid in degrading the component, such as, for example, if the degradable material were composed of a galvanically-corrodible or reacting metal or material. As will be appreciated, the accelerant may comprise any form, including a solid form or a liquid form.

Suitable accelerants may include, but are not limited to, a chemical, a crosslinker, sulfur, a sulfur-releasing agent, a peroxide, a peroxide releasing agent, a catalyst, an acid releasing agent, a base releasing agent, and any combination thereof. In some embodiments, the accelerant may cause the degradable material to become brittle to aid in degradation. Specific accelerants may include, but are not limited to, a polylactide, a polyglycolide, an ester, a cyclic ester, a diester, an anhydride, a lactone, an amide, an anhydride, an alkali metal alkoxide, a carbonate, a bicarbonate, an alcohol, an alkali metal hydroxide, ammonium hydroxide, sodium hydroxide, potassium hydroxide, an amine, an alkanol amine, an inorganic acid or precursor thereof (e.g., hydrochloric acid, hydrofluoric acid, ammonium bifluoride, and the like), an organic acid or precursor thereof (e.g., formic acid, acetic acid, lactic acid, glycolic acid, aminopolycarboxylic acid, polyaminopolycarboxylic acid, and the like), and any combination thereof.

When embedded in the degradable material, the accelerant, may be present in the range of from a lower limit of about 0.001%, 0.01%, 0.1%, 1%, 2%, 3%, 4%, 5%, 6%, 7%, 8%, 9%, 10%, and 11% to an upper limit of about 25%, 24%, 23%, 22%, 21%, 20%, 19%, 18%, 17%, 16%, 15%, 14%, 13%, 12%, and 11% by weight of the material forming the degradable material.

In some embodiments, the degradable material, including any additional material that may be embedded therein, may be present in a given component of the wellbore isolation device 200 uniformly (i.e., distributed uniformly throughout). In other embodiments, however, the degradable material and any additional material embedded therein may be non-uniformly distributed throughout one or more of the components such that one portion or section of a given component degrades faster or slower than adjacent portions or sections. The choices and relative amounts of each composition or substance may be adjusted for the particular downhole operation (e.g., fracturing, work-over, and the like) and the desired degradation rate (i.e., accelerated, rapid, or normal) of the degradable material for the component. Factors that may affect the selection and amount of compositions or substances may include, for example, the temperature of the subterranean formation in which the downhole operation is being performed, the expected amount of aqueous and/or hydrocarbon fluid in the wellbore environment, the amount of elasticity required for the component (e.g., based on wellbore diameter, for example), and the like.

In some embodiments, blends of certain degradable materials may also be suitable as the degradable material for the components of the wellbore isolation device 200. One example of a suitable blend of degradable materials is a mixture of PLA and sodium borate where the mixing of an acid and base could result in a neutral solution where this is desirable. Another example may include a blend of PLA and boric oxide. The choice of blended degradable materials also can depend, at least in part, on the conditions of the well, e.g., wellbore temperature. For instance, lactides have been found to be suitable for lower temperature wells, including those within the range of 60° F. to 150° F., and PLAs have been found to be suitable for well bore temperatures above this range. Also, PLA may be suitable for higher temperature wells. Some stereoisomers of poly(lactide) or mixtures of such stereoisomers may be suitable for even higher temperature applications. Dehydrated salts may also be suitable for higher temperature wells. Other blends of degradable materials may include materials that include different alloys including using the same elements but in different ratios or with a different arrangement of the same elements.

In some embodiments, the degradable material may include a material that has undergone different heat treatments and therefore exhibits varying grain structures or precipitation structures. As an example, in some magnesium alloys, the beta phase can cause accelerated corrosion if it occurs in isolated particles. Homogenization annealing for various times and temperatures causes the beta phase to occur in isolated particles or in a continuous network. In this way, the corrosion behavior can be very different for the same alloy with different heat treatments.

In some embodiments, the degradable material may be at least partially encapsulated in a second material or "sheath" disposed on all or a portion of a given component of the wellbore isolation device 200. The sheath may be configured to help prolong degradation of the given component of the wellbore isolation device 200. The sheath may also serve to protect the component from abrasion within the wellbore 106. The sheath may be permeable, frangible, or comprise a material that is at least partially removable at a desired rate within the wellbore environment. In either scenario, the sheath may be designed such that it does not interfere with the ability of the wellbore isolation device 200 to form a fluid seal in the wellbore 106.

The sheath may comprise any material capable of use in a downhole environment and, depending on the component that the sheath encapsulates, the sheath may or may not be elastic such that it is able to expand with corresponding expansion of the component. A frangible sheath may break as the packer elements 220, for instance, expand to form a fluid seal, whereas a permeable sheath may remain in place on the packer elements 220 as they form the fluid seal. As used herein, the term "permeable" refers to a structure that permits fluids (including liquids and gases) therethrough and is not limited to any particular configuration.

The sheath may comprise any of the afore-mentioned degradable materials. In some embodiments, the sheath may be made of a degradable material that degrades at a rate that is faster than that of the underlying degradable material that forms the component. Other suitable materials for the sheath include, but are not limited to, a TEFLON® coating, a wax, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, and any combination thereof.

In some embodiments, all or a portion of the outer surface of a given component of the wellbore isolation device 200 may be treated to impede degradation. For example, the outer surface of a given component may undergo a treatment that aids in preventing the degradable material (e.g., a galvanically-corrodible metal) from galvanically-corroding. Suitable treatments include, but are not limited to, an anodizing treatment, an oxidation treatment, a chromate conversion treatment, a dichromate treatment, a fluoride anodizing treatment, a hard anodizing treatment, and any combination thereof. Some anodizing treatments may result in an anodized layer of material being deposited on the outer surface of a given component. The anodized layer may comprise materials such as, but not limited to, ceramics, metals, polymers, epoxies, elastomers, or any combination thereof and may be applied using any suitable processes known to those of skill in the art. Examples of suitable processes that result in an anodized layer include, but are not limited to, soft anodize coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating.

In some embodiments, all or a portion of the outer surface of a given component of the wellbore isolation device 200 may be treated or coated with a substance configured to enhance degradation of the degradable material. For example, such a treatment or coating may be configured to remove a protective coating or treatment or otherwise accelerate the degradation of the degradable material of the given component. An example is a galvanically-corroding metal material coated with a layer of PGA. In this example, the PGA would undergo hydrolysis and cause the surrounding fluid to become more acidic, which would accelerate the degradation of the underlying metal.

In some embodiments, the degradable material may be made of dissimilar metals that generate a galvanic coupling that either accelerates or decelerates the degradation rate of the component. As will be appreciated, such embodiments may depend on where the dissimilar metals lie on the galvanic potential. In at least one embodiment, a galvanic coupling may be generated by embedding a cathodic substance or piece of material into an anodic structural element. For instance, the galvanic coupling may be generated by dissolving aluminum in gallium. A galvanic coupling may also be generated by using a sacrificial anode coupled to the degradable material. In such embodiments, the degradation rate of the degradable material may be decelerated until the sacrificial anode is dissolved or otherwise corroded away. As an example, while all of the components of the plug might be made out of corrodible material, the mandrel might be a more electronegative material than the wedges or slips. In this instance, the galvanic couple between the mandrel and the wedges/slips would cause the mandrel to act as an anode and degrade before the wedges/slips. Once the mandrel has degraded, the wedges/slips would degrade by themselves.

Referring again generally to FIG. 2, the frac ball 208 and the mule shoe 222 may be made of a degradable material that exhibits a first degradation rate $R_1$; the mandrel 206 may be made of a degradable material that exhibits a second degradation rate $R_2$; and the upper and lower slips 216*a,b* and the upper and lower slip wedges 218*a,b* may be made of a degradable material that exhibits a third degradation rate $R_3$, where $R_1<R_2<R_3$. Accordingly, in such embodiments, the frac ball 208 and the mule shoe 222 may be configured to degrade first, then the mandrel 206, and lastly the upper and lower slips 216*a,b* and the upper and lower slip wedges 218*a,b*. Such an embodiment may prove advantageous in allowing the frac ball 208, the mule shoe 222, and the mandrel 206 to perform their respective operations (e.g., guiding the wellbore isolation device 200 through the wellbore 106, allowing the wellbore isolation device 200 stroke length to set, and facilitate zonal isolation) and then degrade a short time thereafter while the wellbore isolation device 200 remains anchored in the wellbore 106. Since the mule shoe 222 and the mandrel 206 account for a large portion of the mass of the wellbore isolation device 200, having them dissolve or degrade first may be preferred. The upper and lower slips 216*a,b* and the upper and lower slip wedges 218*a,b* degrade at a slower degradation rate, and thereby allow the wellbore isolation device 200 to remain anchored to the casing 114 while the mule shoe 222 and the mandrel 206 dissolve. In some embodiments, the packer elements 220 may also be made of a degradable material and may be configured to degrade at substantially the same rate as the mandrel 206.

In one or more additional embodiments, all of the components of the wellbore isolation device 200 may be painted or otherwise coated with paint except for the walls of the central flow passage 210 and the frac ball 208. In such embodiments, degradation of the painted components will be substantially prevented or otherwise decelerated. Degradation of the mandrel 206 may proceed outward from the central flow passage 210 and toward the casing 114.

In one or more additional embodiments, the upper and lower slips 216*a,b* and the upper and lower slip wedges 218*a,b* may be highly anodized or otherwise coated with a thicker anodized coating, while the mandrel 206 is weakly anodized or otherwise coated with a thinner anodized coating, and the frac ball 208 is not anodized. In such an embodiment, the frac ball 208 may be configured to degrade first, and the mandrel 206 may degrade at a more rapid degradation rate than the upper and lower slips 216*a,b* and the upper and lower slip wedges 218*a,b*.

In yet one or more additional embodiments, the degradable material of the mandrel 206 may be a nano-structured magnesium alloy with iron-coated inclusions, the degradable material of the upper and lower slip wedges 218*a,b* may be an aluminum-gallium solution, and the degradable material of the upper and lower slips 216*a,b* may be a fiber-reinforced composite. In such an embodiment, the mandrel 206 may be configured to chemically react with the upper and lower slip wedges 218*a,b* and thereby galvanically-corrode, but the upper and lower slips 216*a,b* may degrade at a slower degradation rate.

Embodiments disclosed herein include:

A. A downhole tool that includes a wellbore isolation device that provides a plurality of components including one or more first components and one or more second components, wherein each component is made of a degradable material that degrades when exposed to a wellbore environment, and wherein the one or more first components degrades at a first degradation rate and the one or more second components degrades at a second degradation rate that is slower than the first degradation rate.

B. A method that includes introducing a wellbore isolation device into a wellbore, the wellbore isolation device providing a plurality of components including one or more first components and one or more second components, wherein each component is made of a degradable material that degrades when exposed to a wellbore environment, anchoring the wellbore isolation device within the wellbore at a target location, performing at least one downhole operation, degrading the one or more first components at a first degradation rate, and degrading the one or more second components at a second degradation rate that is slower than the first degradation rate.

C. A hydraulic frac plug that includes a mandrel having a central flow passage defined therethrough, one or more packer elements disposed about the mandrel and expandable to seal against a wellbore, an upper slip wedge and a lower slip wedge each disposed about the mandrel on opposing sides of the one or more packer elements, and an upper slip and a lower slip each disposed about the mandrel on opposing sides of the one or more packer elements and actuatable to anchor the hydraulic frac plug within the wellbore, wherein at least the mandrel, the upper and lower slip wedges, and the upper and lower slips are each made of a degradable material that degrades when exposed to a wellbore environment, wherein the degradable material of at least one of the mandrel, the upper and lower slip wedges, and the upper and lower slips degrades at a first degradation rate, and wherein the degradable material of at least another one of the mandrel, the upper and lower slip wedges, and the upper and lower slips degrades at a second degradation rate that is slower than the first degradation rate.

D. A method that includes introducing a hydraulic frac plug into a wellbore, the hydraulic frac plug including a mandrel having a central flow passage defined therethrough, an upper slip wedge and a lower slip wedge each disposed about the mandrel, and an upper slip and a lower slip each disposed about the mandrel, wherein the mandrel, the upper and lower slip wedges, and the upper and lower slips are each made of a degradable material that degrades when exposed to a wellbore environment, actuating the upper and lower slips and thereby anchoring the hydraulic frac plug within the wellbore at a target location, performing at least one downhole operation, degrading the degradable material of at least one of the mandrel, the upper and lower slip wedges, and the upper and lower slips at a first degradation rate, and degrading the degradable material of at least another one of the mandrel, the upper and lower slip wedges, and the upper and lower slips at a second degradation rate that is slower than the first degradation rate.

Each of embodiments A, B, C, and D may have one or more of the following additional elements in any combination: Element 1: wherein the wellbore isolation device is selected from the group consisting of a frac plug, a frac ball, a bridge plug, a wellbore packer, a wiper plug, a cement plug, and any combination thereof. Element 2: wherein the plurality of components includes a body and an anchoring mechanism that is actuatable to anchor the body within the wellbore, and wherein the one or more first components includes the body, and the one or more second components includes the anchoring mechanism. Element 3: wherein the degradable material is selected from the group consisting of borate glass, polyglycolic acid, polylactic acid, a degradable polymer, a degradable rubber, a galvanically-corrodible metal, a dehydrated salt, a dissolvable metal, a blend of dissimilar metals that generates a galvanic coupling, and any combination thereof. Element 4: wherein the degradable material includes an accelerant that is releasable during degradation to accelerate degradation of at least one of the one or more first components and the one or more second components. Element 5: further comprising a sheath disposed on all or a portion of at least one of the one or more first components and the one or more second components. Element 6: wherein the sheath is a material selected from the group consisting of a TEFLON® coating, a wax, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, and any combination thereof. Element 7: wherein all or a portion of an outer surface of at least one of the one or more first components and the one or more second components is treated with a treatment to slow degradation of the degradable material. Element 8: wherein the treatment is selected from the group consisting of an anodizing treatment, an oxidation treatment, a chromate conversion treatment, a dichromate treatment, a fluoride anodizing treatment, a hard anodizing treatment, and any combination thereof.

Element 9: wherein the plurality of components includes a body and an anchoring mechanism that is actuatable to anchor the body within the wellbore, and wherein the one or more first components includes the body and the one or more second components includes the anchoring mechanism, the method further comprising degrading the degradable material of the body faster than the degradable material of the anchoring mechanism. Element 10: wherein the degradable material is selected from the group consisting of borate glass, polyglycolic acid, polylactic acid, a degradable polymer, a degradable rubber, a galvanically-corrodible metal, a dehydrated salt, a blend of dissimilar metals that generates a galvanic coupling, and any combination thereof. Element 11: further comprising releasing an accelerant as the one or more first components or the one or more second components degrades, and accelerating the degradation of at least one of the one or more first components and the one or more second components with the accelerant. Element 12: further comprising slowing a degradation of at least one of the one or more first components and the one or more second components with a sheath disposed on all or a portion of the at least one of the one or more first components and the one or more second components. Element 13: further comprising slowing a degradation of at least one of the one or more first components and the one or more second components with a treatment applied on all or a portion of the at least one of the one or more first components and the one or more second components.

Element 14: wherein the degradable material of the mandrel degrades at the first degradation rate, and the degradable material of the upper and lower slip wedges and the upper and lower slips degrades at the second degradation rate. Element 15: wherein the degradable material is selected from the group consisting of borate glass, polyglycolic acid, polylactic acid, a degradable polymer, a degradable rubber, a galvanically-corrodible metal, a dehydrated salt, a blend of dissimilar metals that generates a galvanic coupling, and any combination thereof. Element 16: wherein the degradable material includes an accelerant that is releasable during degradation to accelerate degradation of at least one of the mandrel, the upper and lower slip wedges, and the upper and lower slips. Element 17: further comprising a sheath disposed on all or a portion of at least one of the mandrel, the upper and lower slip wedges, and the upper and lower slips. Element 18: wherein all or a portion of an outer surface of at least one of the mandrel, the upper and lower slip wedges, and the upper and lower slips is treated with a treatment to slow degradation of the degradable material. Element 19: wherein paint is applied to outer surfaces of the mandrel, the upper and lower slips, and the upper and lower slip wedges, and degradation of the degradable material commences at the central flow passage.

Element 20: wherein the degradable material of the mandrel degrades at the first degradation rate, and the degradable material of the upper and lower slip wedges and the upper and lower slips degrades at the second degradation rate, the method further comprising degrading the degradable material of the mandrel faster than the degradable material of the upper and lower slip wedges and the upper and lower slips. Element 21: further comprising releasing an accelerant as at least one of the mandrel, the upper and lower slip wedges, and the upper and lower slips degrades, and accelerating the degradation of the at least one of the mandrel, the upper and lower slip wedges, and the upper and lower slips with the accelerant. Element 22: further comprising slowing a degradation of at least one of the mandrel, the upper and lower slip wedges, and the upper and lower slips degrades with a sheath disposed on all or a portion of the at least one of the mandrel, the upper and lower slip wedges, and the upper and lower slips degrades. Element 23: further comprising slowing a degradation of at least one of the mandrel, the upper and lower slip wedges, and the upper and lower slips degrades with a treatment applied on all or a portion of the at least one of the mandrel, the upper and lower slip wedges, and the upper and lower slips degrades. Element 24: wherein paint is applied to outer surfaces of the mandrel, the upper and lower slips, and the upper and lower slip wedges, the method further comprising degrading the degradable material of the mandrel commencing at the central flow passage.

By way of non-limiting example, exemplary combinations applicable to A, B, C include: Element 7 with Element 8; Element 14 with Element 15; Element 3 with Element 7; Element 3 with Element 8; Element 10 with Element; Element 15 with Element 16; Element 16 with Element 17; Element 15 with Element 18; Element 20 with Element 21; and Element 20 with Element 22.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A downhole tool, comprising:

a wellbore isolation device that provides a plurality of components including one or more first components, one or more second components, and one or more third components, wherein the one or more third components anchor the downhole tool, each component is made of a degradable material that degrades when exposed to a wellbore environment, and the one or more third components degrade to detach the downhole tool, and wherein the one or more first components degrades at a first degradation rate, the one or more second components degrades at a second degradation rate that is slower than the first degradation rate, and the one or more third components degrades at a third degradation rate that is slower than the second degradation rate to degrade the one or more second components to a state of lost integrity prior to the detachment of the downhole tool due to the degradation of the one or more third components.

2. The downhole tool of claim 1, wherein the wellbore isolation device is selected from the group consisting of a frac plug, a frac ball, a bridge plug, a wellbore packer, a wiper plug, a cement plug, and any combination thereof.

3. The downhole tool of claim 1, wherein the one or more first components includes a frac ball, the one or more second components includes a body the one or more third components includes an anchoring mechanism, and the anchoring mechanism is actuatable to anchor the body within the wellbore.

4. The downhole tool of claim 1, wherein the degradable material is selected from the group consisting of borate glass, polyglycolic acid, polylactic acid, a degradable polymer, a degradable rubber, a galvanically-corrodible metal, a dehydrated salt, a dissolvable metal, a blend of dissimilar metals that generates a galvanic coupling, and any combination thereof.

5. The downhole tool of claim 1, wherein the degradable material includes an accelerant that is releasable during degradation to accelerate degradation of at least one of (i) the one or more first components or (ii) the one or more second components.

6. The downhole tool of claim 1, further comprising a sheath disposed on all or a portion of at least one of (i) the one or more first components or (ii) the one or more second components.

7. The downhole tool of claim 6, wherein the sheath is a material selected from the group consisting of a TEFLON® coating, a wax, a drying oil, a polyurethane, an epoxy, a crosslinked partially hydrolyzed polyacrylic, a silicate material, a glass, a polymer, polylactic acid, polyvinyl alcohol, polyvinylidene chloride, a hydrophobic coating, paint, and any combination thereof.

8. The downhole tool of claim 1, wherein all or a portion of an outer surface of at least one of (i) the one or more first components or (ii) the one or more second components is treated with a treatment to slow degradation of the degradable material.

9. The downhole tool of claim 8, wherein the treatment is selected from the group consisting of an anodizing treatment, an oxidation treatment, a chromate conversion treatment, a dichromate treatment, a fluoride anodizing treatment, a hard anodizing treatment, and any combination thereof.

10. A method, comprising:

introducing a wellbore isolation device into a wellbore, the wellbore isolation device providing a plurality of components including one or more first components, one or more second components, and one or more third components, wherein each component is made of a degradable material that degrades when exposed to a wellbore environment;

anchoring the wellbore isolation device within the wellbore at a target location via the one or more third components;

performing at least one downhole operation via the one or more first components;

degrading the one or more first components at a first degradation rate;

degrading the one or more second components at a second degradation rate that is slower than the first degradation rate; and degrading the one or more third components at a third degradation rate to detach the wellbore isolation device, wherein the third degradation rate is slower than the second degradation rate to degrade the one or more second components to a state of lost integrity prior to the detachment of the wellbore isolation device via the degradation of the one or more third components.

11. The method of claim 10, wherein the one or more first components includes a frac ball, the one or more second components includes a body, the one or more second third components includes an anchoring mechanism, and the anchoring mechanism is actuatable to anchor the body within the wellbore, the method further comprising:

degrading the degradable material of the body faster than the degradable material of the anchoring mechanism.

12. The method of claim 10, wherein the degradable material is selected from the group consisting of borate glass, polyglycolic acid, polylactic acid, a degradable polymer, a degradable rubber, a galvanically-corrodible metal, a dehydrated salt, a blend of dissimilar metals that generates a galvanic coupling, and any combination thereof.

13. The method of claim 10, further comprising:

releasing an accelerant as (i) the one or more first components or (ii) the one or more second components degrades; and accelerating the degradation of at least one of (i) the one or more first components or (ii) the one or more second components with the accelerant.

14. The method of claim 10, further comprising slowing a degradation of at least one of (i) the one or more first components or (ii) the one or more second components with a sheath disposed on all or a portion of (i) the at least one of the one or more first components or (ii) the one or more second components.

15. The method of claim 10, further comprising slowing a degradation of at least one of (i) the one or more first components or (ii) the one or more second components with a treatment applied on all or a portion of (i) the at least one of the one or more first components or (ii) the one or more second components.

16. A hydraulic frac plug, comprising:

a mandrel having a central flow passage defined therethrough;

a mule shoe secured to the mandrel;

a frac ball disposed at an upper end of the mandrel;

one or more packer elements disposed about the mandrel and expandable to seal against a wellbore;

an upper slip wedge and a lower slip wedge each disposed about the mandrel on opposing sides of the one or more packer elements; and an upper slip and a lower slip each disposed about the mandrel on opposing sides of the one or more packer elements and actuatable to anchor the hydraulic frac plug within the wellbore, wherein at least the mandrel, the mule shoe, the frac ball, the upper and lower slip wedges, and the upper and lower slips are each made of a degradable material that degrades when exposed to a wellbore environment, and the upper and lower slip wedges, or the upper and lower slips degrade to detach the hydraulic frac plug, wherein the degradable material of the mule shoe and the frac ball degrades at a first degradation rate, wherein the degradable material of the mandrel degrades at a second degradation rate that is slower than the first degradation rate, and wherein the degradable material of at least one of the upper and lower slip wedges, or the upper and lower slips degrades at a third degradation rate that is slower than the second degradation rate to degrade the mandrel to a state of lost integrity prior to the detachment of the hydraulic frac plug due to the degradation of the at least one of the upper and lower slip wedges, or the upper and lower slips.

17. The hydraulic frac plug of claim 16, wherein the degradable material is selected from the group consisting of borate glass, polyglycolic acid, polylactic acid, a degradable polymer, a degradable rubber, a galvanically-corrodible metal, a dehydrated salt, a blend of dissimilar metals that generates a galvanic coupling, and any combination thereof.

18. The hydraulic frac plug of claim 16, wherein the degradable material includes an accelerant that is releasable during degradation to accelerate degradation of at least one of the mandrel, the upper and lower slip wedges, or the upper and lower slips.

19. The hydraulic frac plug of claim 16, further comprising a sheath disposed on all or a portion of at least one of the mandrel, the upper and lower slip wedges, or the upper and lower slips.

20. The hydraulic frac plug of claim 16, wherein all or a portion of an outer surface of at least one of the mandrel, the upper and lower slip wedges, or the upper and lower slips is treated with a treatment to slow degradation of the degradable material.

21. The hydraulic frac plug of claim 16, wherein paint is applied to outer surfaces of the mandrel, the upper and lower slips, and the upper and lower slip wedges, and degradation of the degradable material commences at the central flow passage.

22. A method, comprising:

introducing a hydraulic frac plug into a wellbore, the hydraulic frac plug including a mandrel having a central flow passage defined therethrough, a mule shoe secured to the mandrel, a frac ball disposed at an upper end of the mandrel, an upper slip wedge and a lower slip wedge each disposed about the mandrel, and an upper slip and a lower slip each disposed about the mandrel, wherein the mandrel, the mule shoe, the frac ball, the upper and lower slip wedges, and the upper and lower slips are each made of a degradable material that degrades when exposed to a wellbore environment;

actuating the upper and lower slips and thereby anchoring the hydraulic frac plug within the wellbore at a target location;

performing at least one downhole operation via the frac ball;

degrading the degradable material of the mule shoe and the frac ball at a first degradation rate;

degrading the degradable material of the mandrel, at a second degradation rate that is slower than the first degradation rate; and degrading the degradable material of at least one of the upper and lower slip wedges, or the upper and lower slips at a third degradation rate to detach the hydraulic frac plug, wherein the third degradation rate is slower than the first second degradation rate to degrade the mandrel to a state of lost integrity prior to the detachment of the hydraulic frac plug due to the degradation of the at least one of the upper and lower slip wedges, or the upper and lower slips.

23. The method of claim 22, further comprising:

releasing an accelerant as at least one of the mandrel, the upper and lower slip wedges, or the upper and lower slips degrades; and accelerating the degradation of the at least one of the mandrel, the upper and lower slip wedges, or the upper and lower slips with the accelerant.

24. The method of claim 22, further comprising slowing a degradation of at least one of the mandrel, the upper and lower slip wedges, or the upper and lower slips with a sheath disposed on all or a portion of the at least one of the mandrel, the upper and lower slip wedges, or the upper and lower slips degrades.

25. The method of claim 22, further comprising slowing a degradation of at least one of the mandrel, the upper and lower slip wedges, or the upper and lower slips with a treatment applied on all or a portion of the at least one of the mandrel, the upper and lower slip wedges, or the upper and lower slips degrades.

* * * * *